US006505015B1

(12) United States Patent
Winter et al.

(10) Patent No.: US 6,505,015 B1
(45) Date of Patent: Jan. 7, 2003

(54) ELECTROGRAPHIC PRINTING DEVICE WITH A SENSOR FOR DETECTING SLIPPING

(75) Inventors: Hans Winter, München (DE); Walter Kopp, Taufkirchen (DE)

(73) Assignee: Océ Printing Systems GmbH, Poing (DE)

( * ) Notice: Subject to any disclaimer, the term of this patent is extended or adjusted under 35 U.S.C. 154(b) by 0 days.

(21) Appl. No.: 09/857,319

(22) PCT Filed: Dec. 2, 1999

(86) PCT No.: PCT/EP99/09435

§ 371 (c)(1),
(2), (4) Date: Jul. 23, 2001

(87) PCT Pub. No.: WO00/34831

PCT Pub. Date: Jun. 15, 2000

(30) Foreign Application Priority Data

Dec. 4, 1998 (DE) ..... 198 56 145

(51) Int. Cl.[7] ..... G03G 15/16
(52) U.S. Cl. ..... 399/66; 399/302
(58) Field of Search ..... 399/66, 302, 308

(56) References Cited

U.S. PATENT DOCUMENTS 5,515,145 A * 5/1996 Sasaki et al. ..... 399/302
5,640,645 A * 6/1997 Namekata et al. ..... 399/302 X
5,893,018 A * 4/1999 DeBock et al. ..... 399/302
6,038,423 A * 3/2000 Tagawa et al. ..... 399/302 X

FOREIGN PATENT DOCUMENTS

| | | | |
|---|---|---|---|
| DE | 38 08 620 A1 | | 9/1989 |
| DE | 198 06 551 A1 | | 8/1998 |
| DE | 198 21 218 A1 | | 11/1998 |
| EP | 0 281 055 A2 | | 9/1988 |
| EP | 0 523 870 A2 | | 1/1993 |
| JP | 6-8511 | * | 1/1994 |
| JP | 6-27829 | * | 2/1994 |

OTHER PUBLICATIONS

Japanese Abstract, 06008511.
Japanese Abstract, 08076546, Mar. 22, 1996.
Japanese Abstract, 07325455, Dec. 12, 1995.
Japanese Abstract, 06027829, Feb. 4, 1994.

* cited by examiner

*Primary Examiner*—Fred L. Braun
(74) *Attorney, Agent, or Firm*—Schiff Hardin & Waite

(57) ABSTRACT

An electrographic printing device has at least one printing unit with a toner image carrier. A printing device for producing a toner image prints at least one mark on a photoconductor belt. The toner contained on the photoconductor belt is transferred to a transfer belt at a first transfer point and transferred from said transfer belt to a strip-shaped support material at a second transfer point. A sensor situated on the transfer belt detects the passage of the mark and a control unit determines the time that has elapsed between the time of printing and the time at which the mark is detected and controls the transportation of the strip-shaped support material accordingly.

24 Claims, 4 Drawing Sheets

ELECTROGRAPHIC PRINTING DEVICE WITH A SENSOR FOR DETECTING SLIPPING

BACKGROUND OF THE INVENTION

1. Field of the Invention

The present invention is directed to an electrographic printer device with at least one printing unit having a toner image carrier on whose circumferential surface toner can be applied according to an image-like distribution.

2. Description of the Related Art

Such a printer device is utilized in a printer or copier, whereby a latent image is applied on the toner image carrier with the assistance of an electrographic method. This can ensue, for example, by illuminating a photoconductor or by magnetizing a magnetically sensitive layer. Toner agglomerates to the latent image according to the image-like distribution of the electrical charges or of the magnetic poles. This toner is transferred onto a carrier material, generally paper, at a transfer printing location and is fixed thereon later.

An apparatus with such a printer device should work fast and be flexibly employable. Often, toner images must be printed onto a form that has form windows into which individual characters are to be printed. The characters must thereby be positioned exactly within the form windows. Given multi-color printing, the individual chromatic sub-images must be congruently printed in order to generate a multi-color image. All of this makes high demands of the mechanism.

European Patent Document EP 0523870 discloses a printer device wherein a plurality of sub-images of different colors are generated successively and spaced from one another on a photoconductor band. The sub-images are individually transferred onto a sheet-shaped recording medium at a transfer printing location, whereby the recording medium is repeatedly conducted past the transfer printing location such that the sub-images are transfer-printed as congruently as possible. The spacing of two successive sub-images is equal to the circumference of the rollers on which the photoconductor runs or to a multiple thereof, whereby the individual rollers respectively have the same circumference. A non-uniform rotational motion, for example due to an eccentricity of the roller axes, then has the same effect in all sub-images, so that the congruently transfer-printed sub-images yield a full-color image without color errors.

Given the known printer device, a slippage can occur between the drive rollers and the photoconductor band. For example, the unrolled circumference of the drive roller in a revolution is longer than the distance by which the photoconductor band moves forward. Moreover, the mechanics at the transfer printing locations can change. When printing on a form, for example, it is important that the toner image is printed in predetermined sections of the form. The slippage between the photoconductor band and the drive rollers is not constant but can change due to external influences such as, for example, temperature or atmospheric humidity or as a result of aging. The changes in the mechanism at the transfer printing locations are also dependent on external influences. These changes are difficult to determine. When the toner images can no longer be precisely printed onto the form due to a slippage or a modifications of the mechanics, this is often only noticed later and leads to rejects.

German Patent Document DE 198 21 218 shows a printer device wherein the differently colored sub-images are to be congruently transfer-printed onto a transfer band. For this purpose, a number of marks which are detected when they pass by a sensor are arranged at the transfer band. The detection signal of the marks is kept in a fixed phase relation with a line synchronization signal by controlling the circumferential speed of the transfer band. This requires a substantial circuit outlay.

Another printer device wherein differently colored sub-images are congruently transfer-printed is disclosed by the German Patent Document DE 198 06 551. Given this printer device, one mark for each sub-image is printed onto a paper web as the recording medium. The reflectivity of the marks congruently printed on top of one another is measured for checking the alignment of the individual sub-images relative to one another. The drive of the individual printing units is regulated on the basis of this check result. This printer device, too, requires considerable circuit outlay. A positionally exact printing in a form window cannot be achieved given this known printed device.

Given a printer device disclosed by the German Patent Document DE 38 08 620, the leading edge of a sheet-shaped recording medium is detected with a sensor and the feed of the recording medium is controlled dependent on this detection.

Although a positionally exact printing in a form window can thereby be achieved given a sheet-shaped recording medium, this does not lead to the desired outcome given a band-shaped recording medium.

European Patent Document EP 0 281 055 recites a printer device wherein a position sensor for a drum is provided. This printer device, too, can only be employed for sheet-shaped recording media.

Patent Abstracts of Japan JP-A-06027829 discloses components of a printer device wherein a mark is applied on a transfer band, the mark being moved past a sensor together with the transfer band. The passing of the mark is acquired with the assistance of a controller and the rotational speed of the transfer band is identified. Dependent on the result of the determination of the rotational speed, a drive motor is influenced with the assistance of a further controller in order to correct this rotational speed of the transfer band to a predetermined value. It is assured in this way that the transfer band maintains a predetermined rotational speed.

SUMMARY OF THE INVENTION

An object of the PRESENT invention is to provide a printer device that recognizes a transfer of toner images that is not in proper order.

This object is achieved by an electrographic printer device with at least one printing unit having a toner image carrier on whose circumferential surface toner can be applied according to an image-like distribution, whereby the toner image carrier has a photoconductor, whose outer circumferential surface can be charged with a latent charge image, and a transfer band onto which the toner present on the photoconductor can be transferred at a first transfer printing location, a carrier material is conducted past the transfer band such that the toner arranged thereon can be transferred onto the carrier material at a second transfer printing location, a printing mechanism for generating the toner image and that prints at least one mark onto the photoconductor is arranged along a circumferential section of the photoconductor, at least one sensor that acquires the passing of the mark is arranged at the transfer band, a controller determines the transit time of the mark from the printing time of the printing mechanism up to the acquisition time at the sensor, and whereby the transport of the band-shaped carrier material is influenced in controlling fashion dependent on the transit time.

In the invention, the mark moves with a constant speed from the acquisition time until the transfer printing time in the steady state. The time that the toner image requires until the transfer printing onto the carrier material can therefore be calculated from the transit time. When the printing quality deteriorates as a consequence of a change in the slippage, for example due to a modified ambient temperature, this change in slippage also causes a change in the transit time that is monitored by the controller. A change in the slippage is thus indirectly recognized and the printing event can be correspondingly controlled. For example, the transport of the carrier material can be influenced in a controlling fashion dependent on the transit time, for example by halting the printing operation or by readjusting the transport velocity.

In a development of the invention, the transit time is compared to a predetermined rated value, a signal being generated when the latter is upwardly or downwardly transgressed. Given a deviation from the predetermined rated value, the slip has changed or modifications have occurred in the mechanisms. The transport of the band-shaped carrier material can be influenced in a controlling fashion dependent on the generated signal. In one exemplary embodiment of the invention, the operation of the printer device can be interrupted dependent on the signal. The printing of rejects is thus avoided.

According to another example of the invention, the base time that the toner image applied by the printing mechanism requires in order to be transfer-printed at the second transfer printing location is determined in a calibration event. The rated time is then defined on the basis of the base time. For example, the rated time can amount to 98% of the base time. When the transit time of the mark coincides with the rated time in this case, then it is assured that the toner image is transfer-printed onto the carrier material at exactly the desired location.

In a development of the invention, the base time is redetermined given occurrence of the signal. As mentioned, the signal is generated given a deviation of the transit time from the rated time. This means that the base time has changed and the toner images are no longer printed onto the carrier material at the desired location. The base time must thus be redetermined and the transport of the band-shaped carrier material must be controlled in conformity with the modified slippage. For example, the time between the generation of the latent image and the start of the transport of the carrier material can be adapted to the modified base time.

The sensor is preferably arranged close to the second transfer printing location. The deviation of the transit time from the base time is especially small then. As a result thereof, the toner image can be very precisely placed on the carrier material.

One development is characterized in that the printer device has at least one image generating unit for generating a latent charge image on the photoconductor and at least one developer station that inks the charge image with toner. A uniform print image with a high resolution can be achieved as a result thereof. The printer device can also have a plurality of developer stations, as a result whereof a multicolor printing is possible.

In one version of the invention, a second printing unit for generating a toner image is provided at that side of the carrier material facing away from the first printing unit. A duplex printing is possible in this way, whereby both sides of the carrier material are then simultaneously printed.

According to a further aspect of the invention, the electrographic printer device has at least one printing unit with a toner image carrier on whose circumferential surface the toner can be applied according to an image-like distribution, whereby the toner image carrier has a photoconductor, whose outside circumferential surface can be charged with a latent charge image, and a transfer band onto which the toner present on the photoconductor can be transferred at a first transfer printing location, a carrier material is conducted past the transfer band such that the toner arranged thereon can be transferred onto the carrier material at a second transfer printing location, a printing mechanism for generating the toner image is arranged along a circumferential section of the photoconductor, at least one mark is arranged on the transfer band, at least one sensor that acquires the passing of the mark is arranged at the transfer band, a controller determines the revolution time of the mark on the transfer band, and whereby the printer device is influenced in a controlling fashion dependent on the revolution time.

Given a such a printer device of the invention, successive toner images can be congruently transfer-printed onto the transfer band. The revolution time of the mark is determined by the controller on the basis of the acquisition of the passing of the mark at the sensor, whereby the revolution time likewise changes given a change in the slip or, respectively, given a change in the length of the transfer band. As a result thereof, a change in slip or, respectively, a change in the length of the band is recognized, and the printing event can be controlled dependent on the revolution time. Although the slippage itself or, respectively, the change in length of the transfer band is not identified, the toner images can be precisely arranged thereon in this way.

Preferably, the time between the application of two successive toner images on the photoconductor is determined on the basis of the revolution time. The photoconductor and the transfer band thereby run with the same, constant speed. The toner images can thus be placed exactly on the transfer band in an especially simple way.

In one development, the revolution time is determined in a calibration event. As a result thereof, a revolution time is available for the following printing events on whose basis the time between the application of two successive toner images on the photoconductor band can be determined. Preferably, a calibration event is implemented in parallel to every printing event. The printer device can thus be especially quickly and exactly controlled.

In a collecting mode, the transfer band is repeatedly conducted past the first transfer printing location, and a toner image is transferred onto the transfer band onto the previous toner image at every renewed passage. In this way, toner images can be especially simply superimposed. A cleaning mechanism of the transfer band should thereby be pivoted away from it.

At every repeated passage, the transfer band is pivoted away from the carrier material so that a contamination of the carrier material and a smearing of the toner images on the transfer band are avoided.

One development is characterized in that, based on the revolution time, the time between the application of two successive toner images onto the photoconductor is set such that they are congruently transfer-printed when the transfer band passes by the first transfer printing location. The transfer band runs with a constant speed, and a change in the revolution time then means that the length of the transfer band has changed. The time between the application of two successive toner images onto the transfer band must thus be modified.

The mark can be permanently arranged on the transfer band. For example, a reflective lamina can be glued or riveted onto the transfer band or the mark can be a slot in the transfer band. A long service life and a high precision in the determination of the revolution time are thus assured.

In one development, a reflex sensor that detects the passing of the toner mark is employed. A simple structure derives as a result thereof.

BRIEF DESCRIPTION OF THE DRAWINGS

The invention is explained in greater detail below on the basis of the drawing.

DETAILED DESCRIPTION OF THE PREFERRED EMBODIMENTS

Figure 1:
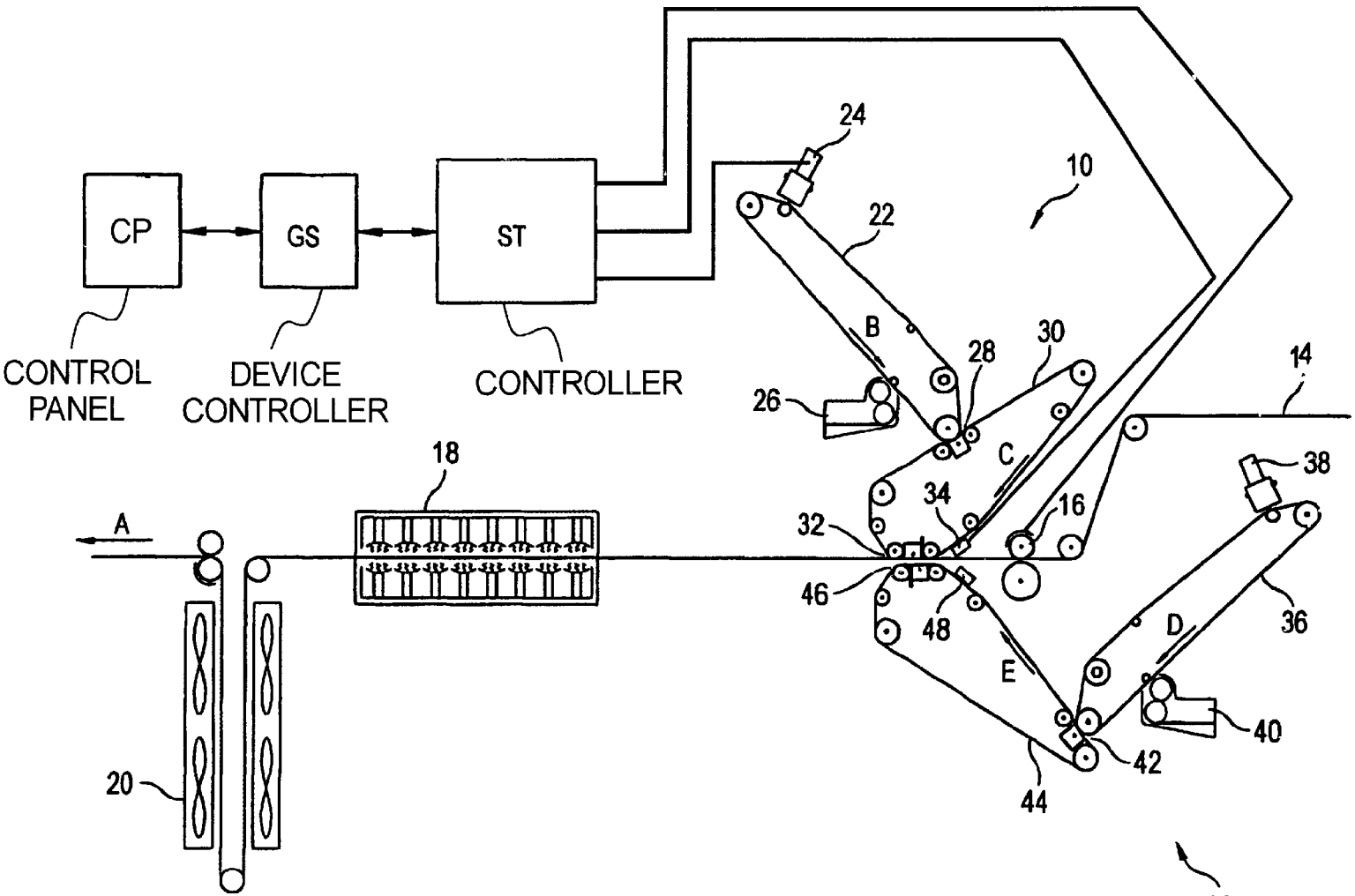
FIG. 1 is a schematic illustration of an exemplary embodiment of a printer device with a sensor for the acquisition of a mark.

FIG. 1 shows an exemplary embodiment of a printer device with a first printing unit 10 and with a second printing unit 12 that are arranged at surfaces of a paper web 14 that face away from one another. The paper web 14 is moved forward in the direction indicated by the arrow A by a drive roller 16. It can also be pulled back by the drive roller 16 in order, for example, to realize a defined restart. A fixing station 18 and a cooling device 20 arranged along the paper web 14 in this sequence in forward direction following the printing units 10 and 12. The printer device and its function are described in detail in published PCT Application WO 98/39691, which is a constituent part of this disclosure of this application.

The first printing unit 10 has a first photoconductor band 22 that runs over rollers, which shall not be discussed in further detail here, and that moves in the direction indicated by the arrow B. A first character generator 24 and a first developer station 26 are arranged at the first photoconductor band 22. At a first transfer printing station 28, the first photoconductor band 22 is in contact with a first transfer band 30 (likewise conducted over rollers that are not explained in detail here) that moves in the direction of the arrow C.

At a second transfer printing location 32, the first transfer band 30 is in contact with what is the upper surface of the paper web 14 in FIG. 1. Close to the second transfer printing location 32, a first reflected light barrier 34 is arranged at the first transfer band 30 in its moving direction preceding the second transfer printing location 32.

The second printing unit 12 is constructed similar to the first printing unit 10. It has a second photoconductor band 36, a second character generator 38 and a second developer station 40, whereby the second photoconductor band 36 moves in the direction of the arrow D and is in contact with a second transfer band 44 at a third transfer printing location 42. This moves in the direction of the arrow E and is in contact at a fourth transfer printing location 46 with what is the bottom surface of the paper web 14 in FIG. 1. A second reflected light barrier 48 is arranged at the second transfer band 44 close to the fourth transfer printing location 46.

The printer device has a device controller GS for controlling the printing operation. The device controller GS is connected to a control panel CP with which print commands can be input to it. The controller ST, the device controller GS and the control panel CP as well as their function are described in greater detail in published PCT application WO 98/39691. The controller ST is connected to the character generators 24 and 38, to the reflected light barriers 34 and 48 and to the drive roller 16 via signal lines or, respectively, control lines, which are shown schematically in FIG. 1.

The functioning of the first printing unit 10 is explained below. The same applies to the second printing unit 12. The first character generator 24 applied a latent charge image onto the first photoconductor band 22. The character generator 24 can be an LED character generator, as disclosed, for example, by the published PCT application WO 98/39691, or it can generate the latent image with laser diodes. This charge image is inked with toner by the first developer station 26.

The toner image is transfer-printed onto the first transfer band 30 at the first transfer printing station 28. At the second transfer printing location 32, the toner image is transfer-printed onto the paper web 14 and fixed in the fixing station 18. The paper web 14 heated by the fixing is subsequently cooled in the cooling device 20.

Additionally, the first character generator 24 respectively applies a mark onto the first photoconductor band 22 as a latent image outside the actual printing region at the beginning of each and every image. These marks are likewise inked with toner at the first developer station 26 and transfer-printed onto the first transfer band 30 at the first transfer printing location 28. These toner marks are acquired by the first reflected light barrier 34. Dependent on its acquisition conditions, this generates a signal that is transmitted to the controller ST.

In a calibration event, the base time that a print image requires from the printing time at the first character generator 24 until the transfer printing time onto the paper web 14 at the second transfer printing location is identified. The photoconductor band 22, the transfer band 30 and the paper web move with the same constant speed. The transport of the paper web 14 is started with such a time delay dependent on this base time that the toner images are transfer-printed exactly into the desired form windows at the second transfer printing location 32.

So that the deviation of the transit time of the toner mark from the printing time at the first character generator 24 up to the acquisition time at the first reflected light barrier 34 from the base time is as small as possible, the first reflected light barrier 34 is arranged as close as possible to the second transfer printing location 32. The majority part of the distance, for example 98%, that the toner image covers until the transfer printing onto the paper web 14 is thus monitored. The rated time is then defined as 98% of the base time. The print image is printed into the form on the paper web with the desired precision when the measured transit time corresponds to the rated time. When there is enough space, the reflected light barrier 34 can also be arranged directly at the second transfer printing location 32.

The printing operation is interrupted when the measured transit time upwardly or downwardly transgresses a predetermined limit value. The paper web 14 is pulled back to such an extent that, given a restart of the printing event, the printing can be continued at the most recent printing position without leaving a gap free. A new calibration event is subsequently implemented. To this end, the above-described procedure can be implemented anew or the new base time can be determined from the most recently measured transit time or, respectively, from the average of the most recently measured transit times. A restart of the printing event is then implemented on the basis of this new base time.

Figure 2:
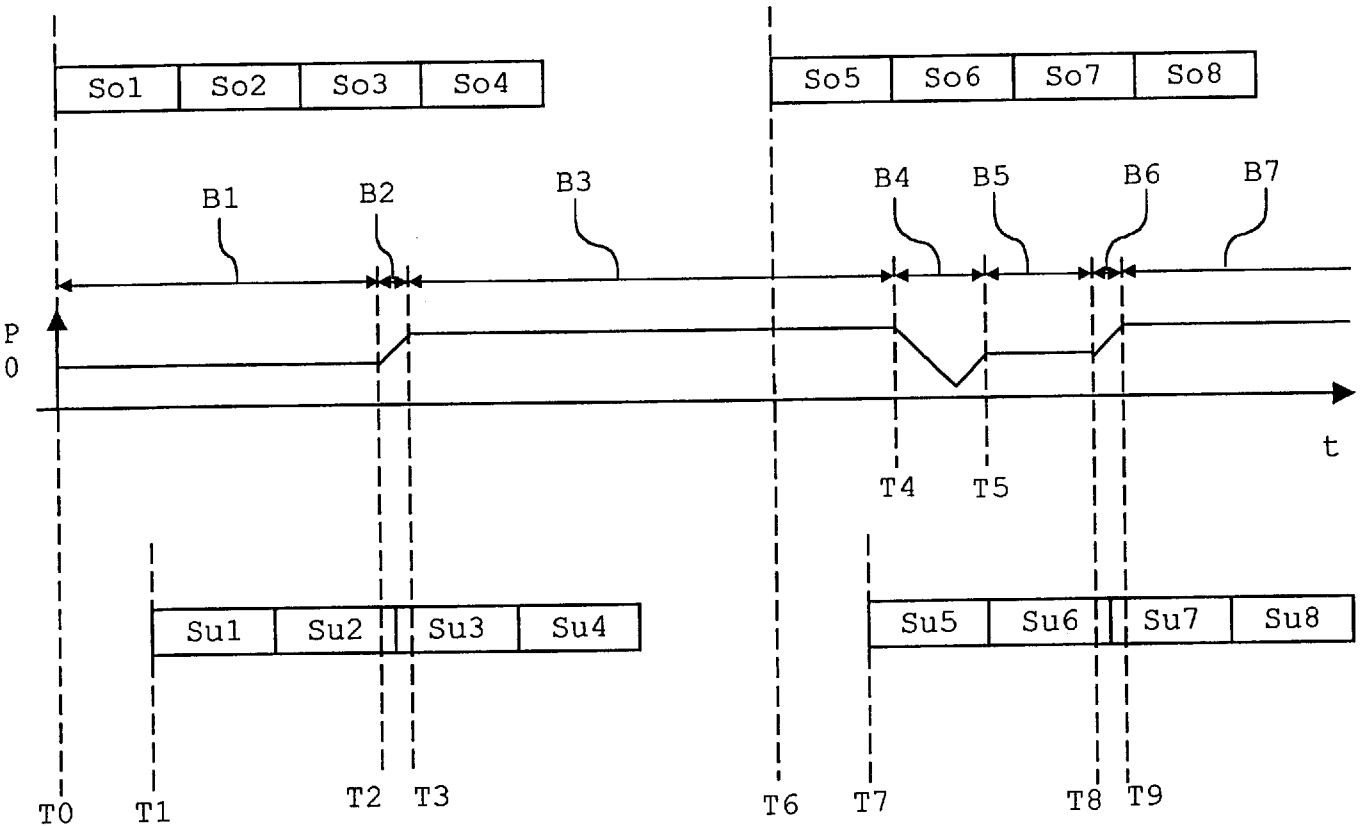
FIG. 2 is a graph of the executive sequence of a printing event of the printer device.

FIG. 2 shows the time sequence of the event that has just been described. The time t is entered as the abscissa and the speed P of the paper web 14 is entered as the ordinate. The paper web 14 is at rest at a time T0 and the first character generator 24 begins to write the four printed pages So1 through So4 onto the first photoconductor band 22. The second character generator 38 begins to write four pages Su1 through Su4 onto the second photoconductor band 36 at a later point in time T1 since the base time for the second printing unit 12 is shorter than for the first printing unit 10. The paper web 14 is then at rest in a region B1 up to a point in time T2. It is then accelerated up to its final speed in a region B2 up to a point in time T3.

In a region B3, the pages So1 through So4 are transfer-printed at the second transfer printing location 32 and the pages Su1 through Su4 are transfer-printed onto the paper web 14 at the fourth transfer printing location 46. When the controller thereby finds a deviation of the measured transit time from the rated time, the print operation is interrupted at a point in time T4. The paper web 14 is stopped in a region B4 up to a point in time T5 and pulled back to such an extent that a new printed page can be printed into the area provided therefor in the next, unprinted form given a restart.

During the event that has just been described, the controller has determined the new base time and lets the first character generator 24 begin—at a time T6—to write four further pages So5 through So8 onto the first photoconductor band. At a later point in time T7, the second character generator 38 also begins to write four further pages Su5 through Su8 onto the second photoconductor band 36.

Dependent on the new base time, the paper web remains at rest in a region B5 up to a new point in time T8 and is again accelerated to its final speed in a region B6. From the point in time T9, the pages So5 through So8 are then transfer-printed onto the paper web 14 at the second transfer printing location 32 and the pages Su5 through Su8 are transfer-printed onto the paper web 14 at the fourth transfer printing location 46 in a region B7.

Figure 3:
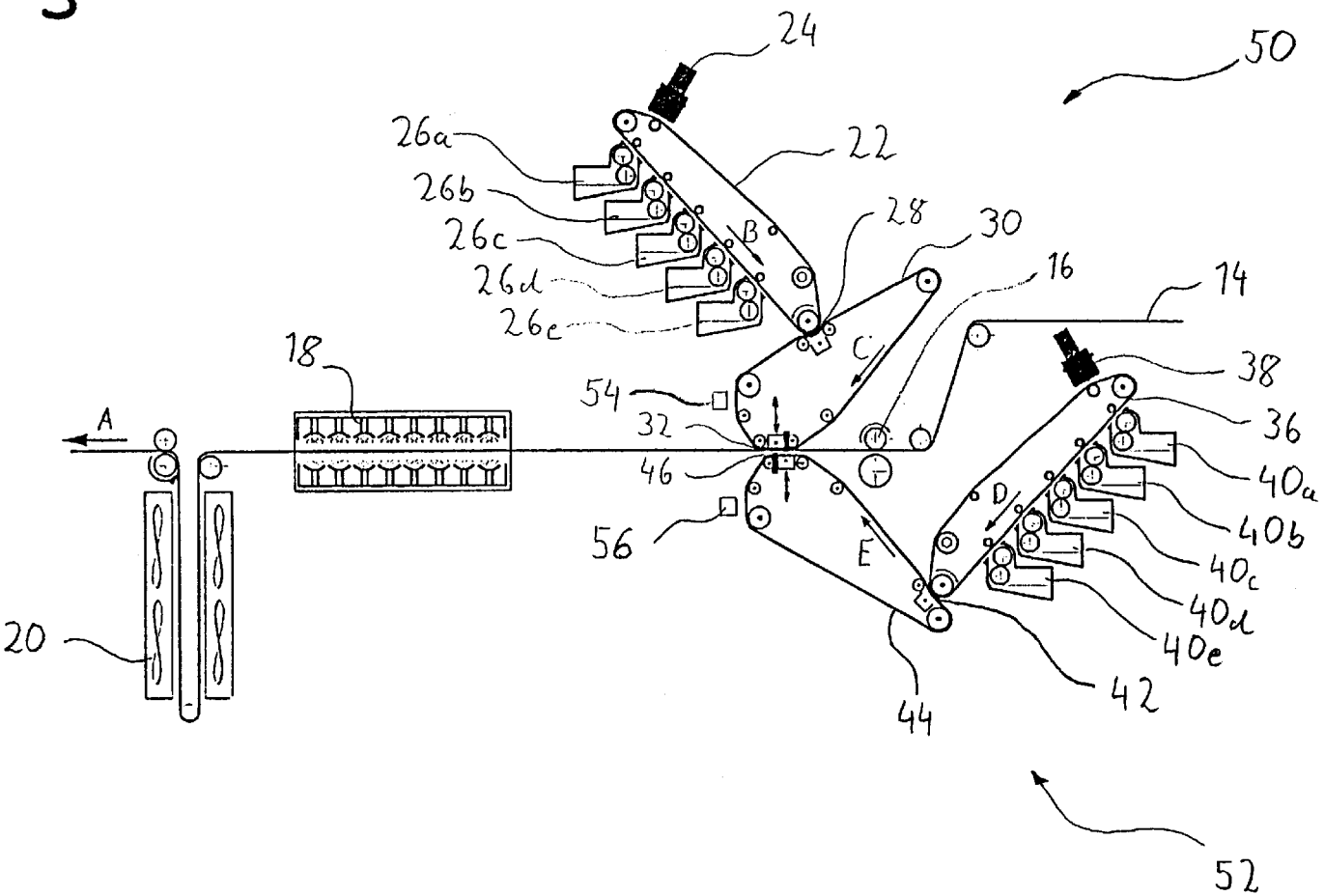
FIG. 3 is a schematic illustration of another exemplary embodiment for multi-color printing.

FIG. 3 shows a second exemplary embodiment of an electrographic printer device with a first printing unit 50 and with a second printing unit 52 similar to the first printing unit 10 and the second printing unit 12 of the first exemplary embodiment in FIG. 1. Identical elements have the same reference characters as therein. Instead of the first developer station 26, five developer stations 26*a* through 26*e* are arranged here at the first photoconductor band 22; and, instead of the second developer station 40, likewise five developer stations 40*a* through 40*e* are arranged at the second photoconductor band 36 here.

A mirror lamina (not shown) is respectively firmly attached to the first and to the second transfer band 30 and 44 as a mark. For detecting the passage of the mark, a first reflected light barrier 54 and a second reflected light barrier 56 are respectively arranged at the first transfer band 30 and at the second transfer band 44.

The printing event of the second exemplary embodiment corresponds to that of the first exemplary embodiment. Over and above this, however, a multi-color print image can be generated on the paper web 14 in the operating mode of "collecting mode" given the second exemplary embodiment. This collecting mode is disclosed in detail in the published PCT application WO 98/39691. The executive sequence of such a collecting mode is explained below only for the first printing unit 50. The same applies to the second printing unit 52.

The transport of the paper web 14 is stopped and this is pulled back to such an extent that transfer printing can be carried out onto the following, unprinted form on the paper web 14 at the second transfer printing location 32 give a restart of the paper transport. Given a first revolution of the first photoconductor band 22, the first character generator 24 generates four latent images corresponding to four printed pages on the band 22. These four latent images are inked with toner in a first color by the developer station 26*a*. These four toner images having the first color are transferred onto the first transfer band 30 at the first transfer printing location.

At the beginning of the collecting mode, the first transfer band 30 is pivoted away from the paper web 14 at the second transfer printing location, so that the toner images do not smear when running past the paper web 14 or do not smear the latter. The first reflected light barrier 54 acquires the mark on the first transfer band 30 and forwards a signal to a controller according to its acquisition condition. The controller is similar to the first exemplary embodiment but is not entered in FIG. 3. It determines the revolution time of the mark from the signals and forms an average therefrom. The first photoconductor band 22 and the first transfer band 30 circulate with the same, constant speed, and, using the revolution time of the mark, the point in time is determined at which the first character generator 24 must begin to generate four further latent images corresponding to four further printed pages on the first photoconductor band 22, so that these are congruently transfer-printed onto the first transfer band 30 onto the four toner images.

At the indicated point in time, the first character generator 24 begins to generate another four latent images corresponding to four more printed pages on the first photoconductor band 22 in a second revolution of the first photoconductor band 22. The developer station 26*b* inks these four latent images with toner in a second color, and these four latent images are congruently transfer-printed onto the first transfer band 30 onto the four toner images with the first color at the first transfer printing location 28.

In a similar way, respectively four further latent images can be successively generated on the photoconductor band 22 by the first character generator 24 in a third, a fourth and in a fifth revolution of the first photoconductor band 22, can be inked with toner of a third, a fourth and a fifth color by the developer stations 26*c*, 26*d* and 26*e*, and can be congruently transfer-printed on the first transfer band 30 onto the four toner images having the first and the second color at the first transfer printing location 28.

In this method, toner images with a number of colors can be congruently transfer-printed on the first transfer band 30 in the collecting mode. Subsequently, the first transfer band 30 is pivoted back against the paper web 14 at the second transfer printing location 32, and the paper transport is restarted such that the four pages which are congruently transfer-printed multi-color on the first transfer band 30 can be transfer-printed onto the desired position on the paper web 14. The collecting mode has thus been ended, and a new collecting mode can be subsequently started or further printing can continuously ensue in one color.

The second printing unit 52 can implement a similar collecting mode parallel to the collecting mode of the first printing unit 10. A different number of developer stations per photoconductor band can also be employed.

Figure 4:
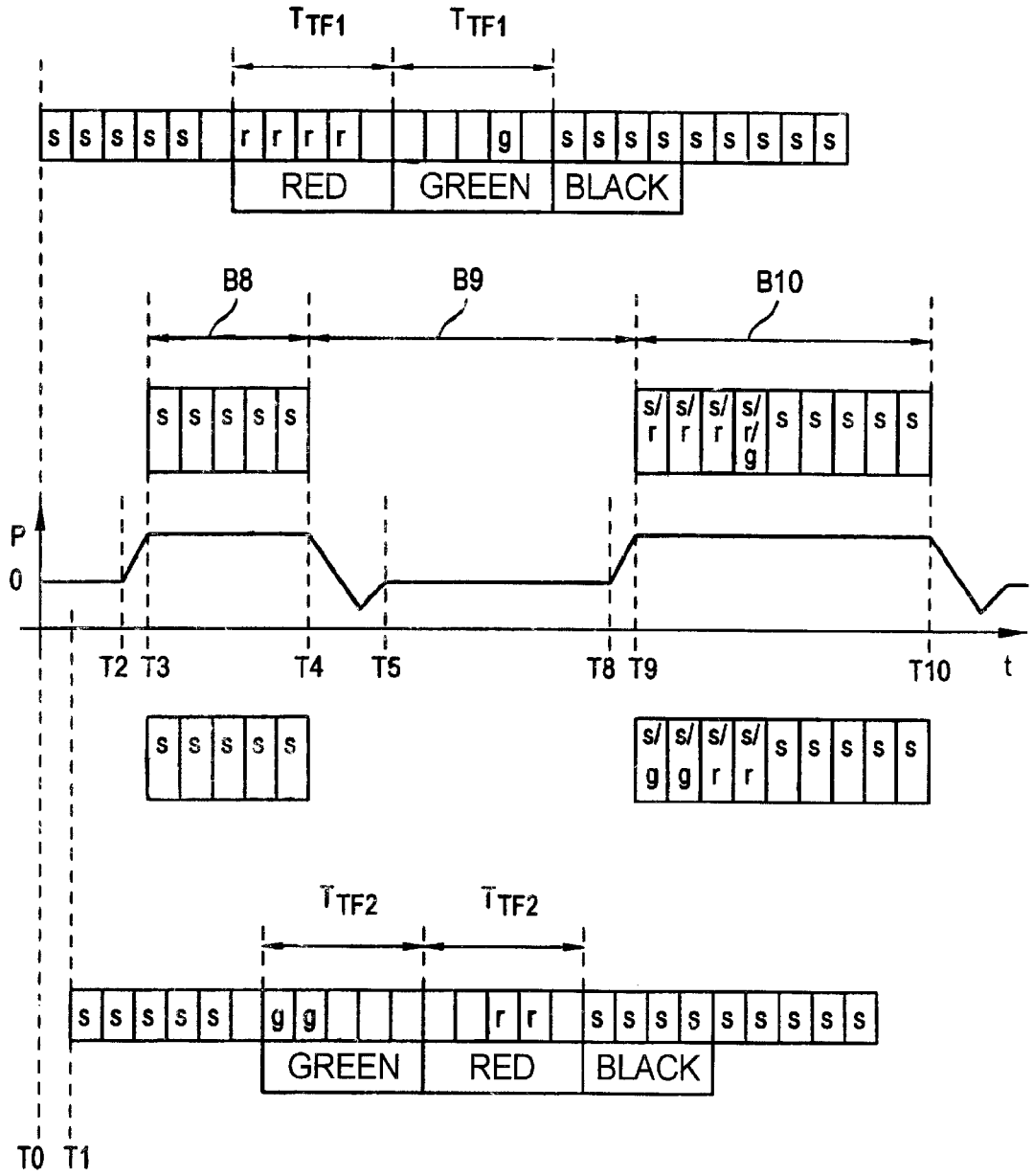
FIG. 4 is a graph of an executive sequence of a collecting mode of the exemplary embodiment according to FIG. 3.

FIG. 4 shows an executive sequence in the collecting mode given the exemplary embodiment of FIG. 3. The time t is entered as the abscissa and the speed P of the paper web 14 is entered as the ordinate. Similar to FIG. 2, the first character generator 24 begins to generate five printed pages as latent images on the first photoconductor band 22 at a time T0. Subsequently, the collecting mode is started, whereby four latent images corresponding to four printed pages are generated on the first photoconductor band 22 by the first character generator 24 during the time $T_{TF1}$ that the first transfer band 30 requires for one revolution, and these are inked with red toner by one of the developer stations, for example the developer station 26*b*.

In a second pass, one latent image is generated on the photoconductor band 22 and, for example, is inked with green toner by the developer station 26*c* because only the fourth page is supposed to contain green; and, in a third pass, four latent images corresponding to four printed pages are again generated, and these are inked with black toner by the developer station 26*c*.

At a time T1 following the time T0, the second character generator 38 also begins to generate five latent images on the second photoconductor band 36. Subsequently, the second printing unit 12 likewise begins a collecting mode, whereby two latent images that the developer station 40*b* inks with green toner are generated during the time $T_{TF2}$ in a first pass of the second transfer band 44. Two latent images are generated in a second pass and four latent images are generated in a third pass, respectively during the time $T_{TF2}$, these being inked with red or, respectively, with black toner by the developer station 40*a* or, respectively, 40*c*.

Similar to FIG. 2, the paper web is accelerated to its final speed from time T2 through time T3. In the region B8, the first five toner images are then respectively transfer-printed onto the paper web 14 at the second or, respectively, fourth transfer printing location 32 and 46. In the region B9, the first and the second transfer band 30 and 44 are pivoted away from the paper web 14 and no transfer-printing of toner images onto the paper web 14 ensues at the second or, respectively, at the fourth transfer printing location 32, 46. The paper web 14 is pulled back between the times T4 and T5 and then remains at rest until the time T8. By time T9, the paper web 14 is again accelerated to its final speed, and the transfer bands 30 and 44 are in turn pivoted against the paper web 14.

In the region B10, the toner images which are transfer-printed onto the transfer bands 30 and 44 during the collecting mode are transfer-printed onto the paper web 14 at the transfer printing locations 32 and 46. Following thereupon, single-color printing can continue without interruption. In FIG. 4, five further printed pages are transfer-printed with black toner by time T10. Subsequently, the paper web is again stopped and pulled back.

So that brief-duration synchronization fluctuations of the photoconductor bands 22 and 36 and of the transfer bands 30 and 44 are as slight as possible and have only a slight influence on the printing quality, the length of the individual bands respectively amounts to a multiple of the circumference of the rollers on which the bands respectively run.

The two exemplary embodiments that have been presented above can also be combined. In this case, a printer device is available with which precision printing can be carried out on a form at high speed. As needed, this printing can also ensue multi-colored.

Given the illustrated exemplary embodiments, a carrier band in the form of a continuous paper web 14 is employed as the carrier material. The invention, however, can also be utilized in printer devices wherein single sheets are employed as the carrier material. The employment of a photoconductor drum is also possible instead of the photoconductor bands 22 and 36.

The above-described printer device is closely related to German patent application 198 56 146.6 which corresponds to PCT application PCT/EP99/09436 (WO 00/34832), whose content is herewith incorporated into the disclosure by reference.

Although other modifications and changes may be suggested by those skilled in the art, it is the intention of the inventor to embody within the patent warranted hereon all changes and modifications as reasonably and properly come within the scope of their contribution to the art.

What is claimed is:

1. An electrographic printer device, comprising:

at least one printing unit including:

a toner image carrier on whose circumferential surface toner is applied according to an image-like distribution, the toner image carrier including a photoconductor whose outer circumferential surface is charged with a latent charge image;

a transfer band onto which the toner present on the photoconductor is transferred at a first transfer printing location;

a carrier material is conducted past the transfer band such that the toner arranged thereon can be transferred onto the carrier material at a second transfer printing location;

a printing mechanism at a circumferential section of the photoconductor for generating a toner image and that prints at least one mark onto the photoconductor;

at least one sensor at the transfer band that acquires a passing of the at least one mark;

a controller connected to said at least one sensor to determine a transit time of the mark from a printing time by the printing mechanism up to an acquisition time by the at least one sensor, said controller influencing transport of the carrier material in controlling fashion dependent on the transit time.

2. An electrographic printer device according to claim 1, wherein said controller compares the transit time to a predetermined threshold, said controller generating a signal given upward or downward transgression of said predetermined threshold.

3. An electrographic printer device according to claim 2, wherein said controller interrupts operation of the printer device dependent on said signal.

4. An electrographic printer device according to claim 2, wherein said controller performs a calibration in which a base time that the toner image applied by the printer device requires in order to be transfer-printed at the second transfer printing location is determined, and said controller determines a rated time on a basis of the base time.

5. An electrographic printer device according to claim 4, wherein said controller redetermines the base time given appearance of the signal.

6. An electrographic printer device according to claim 1, wherein said at least one sensor is arranged close to the second transfer printing location.

7. An electrographic printer device according to claim 1, wherein said at least one sensor is a reflex sensor that acquires a passing of the toner mark.

8. An electrographic printer device according to claim 1, wherein said printer device has at least one image generating unit for generating a latent charge image on the photoconductor band and has at least one developer station that inks the latent charge image with toner.

9. An electrographic printer device according to claim 1, wherein said carrier material is one of a continuous paper web and single sheet material.

10. An electrographic printer device according to claim 1, wherein said photoconductor is one of a photoconductor drum and a photoconductor band.

11. An electrographic printer device according to claim 1, further comprising:

a second printing unit arranged for generating a toner image on that side of the carrier material facing away from the first printing unit such that a duplex printing is performed.

12. An electrographic printer device, comprising:

at least one printing unit having:

a toner image carrier on whose circumferential surface toner is applied according to an image-like distribution, the toner image carrier having a photoconductor, whose outer circumferential surface is charged with a latent charge image;

a transfer band onto which the toner present on the photoconductor is transferred at a first transfer printing location;

a carrier material conducted past the transfer band such that the toner arranged thereon is transferred onto the carrier material at a second transfer printing location;

a printing mechanism arranged along a circumferential section of the photoconductor to generate the toner image;

at least one mark on the transfer band;

at least one sensor arranged at the transfer band that acquires passing of the mark;

a controller operating to determine a revolution time of the mark on the transfer band, said controller influencing the printing event with the printing device in controlling fashion dependent on the revolution time.

13. An electrographic printer device according to claim 12, wherein said controller determines time between application of two successive toner images onto the photoconductor as a basis of the revolution time.

14. An electrographic printer device according to claim 12, wherein said controller determines the revolution time in a calibration event.

15. An electrographic printer device according to claim 12, wherein said printer device includes at least one image generating unit for generating a latent charge image on the photoconductor and at least one developer station that inks the charge image with toner.

16. An electrographic printer device according to claim 12, wherein said transfer band is repeatedly conducted past the first transfer printing location in a collecting mode; and a toner image is transferred onto the transfer band onto the previous toner image at every renewed passage.

17. An electrographic printer device according to claim 16, wherein said transfer band is pivoted away from the carrier material at every second passage.

18. An electrographic printer device according to claim 12, wherein said at least one mark is permanently provided on the transfer band.

19. An electrographic printer device according to claim 12, wherein said at least one sensor is a reflex sensor.

20. An electrographic printer device according to claim 12, wherein said carrier material is one of a continuous paper web and single sheet material.

21. An electrographic printer device according to claim 12, wherein said photoconductor is one of a photoconductor drum and a photoconductor band.

22. An electrographic printer device according claim 12, further comprising:

a second printing unit for generating a toner image on that side of the carrier material facing away from the first printing unit such that a duplex printing is performed.

23. An electrographic printer device, comprising:

at least one printing unit having:

a toner image carrier on whose circumferential surface toner is applied according to an image-like distribution, the toner image carrier having a photoconductor, whose outer circumferential surface is charged with a latent charge image;

a transfer band onto which the toner present on the photoconductor is transferred at a first transfer printing location;

a carrier material conducted past the transfer band such that the toner arranged thereon is transferred onto the carrier material at a second transfer printing location;

a printing mechanism arranged along a circumferential section of the photoconductor to generate the toner image;

at least one mark on the transfer band;

at least one sensor arranged at the transfer band that acquires passing of the mark;

a controller operating to determine a revolution time of the mark on the transfer band, said controller influencing the printing event with the printing device in controlling fashion dependent on the revolution time;

wherein said transfer band is repeatedly conducted past the first transfer printing location in a collecting mode; and a toner image is transferred onto the transfer band onto the previous toner image at every renewed passage; and wherein said controller sets a time between the application of two successive toner images onto the photoconductor on a basis of the revolution time such that they are congruently transfer-printed at the first transfer printing location upon passage of the transfer band.

24. An electrographic printer device according to claim 23, further comprising:

a further developer station so that two successive toner images are respectively inked with toner by different developer stations.

* * * * *